US012127688B1

(12) United States Patent
Budiman

(10) Patent No.: US 12,127,688 B1
(45) Date of Patent: Oct. 29, 2024

(54) EXTENSION LUMBAR SUPPORT PADS FOR OFFICE CHAIR

(71) Applicant: Ali Budiman, Bayside, NY (US)

(72) Inventor: Ali Budiman, Bayside, NY (US)

( * ) Notice: Subject to any disclaimer, the term of this patent is extended or adjusted under 35 U.S.C. 154(b) by 42 days.

(21) Appl. No.: 18/060,950

(22) Filed: Dec. 1, 2022

(51) Int. Cl.

| | |
|---|---|
| ***A47C 7/40*** | (2006.01) |
| ***A47C 7/42*** | (2006.01) |
| *A47C 7/02* | (2006.01) |
| *A47C 7/18* | (2006.01) |
| *A47C 7/46* | (2006.01) |

(52) U.S. Cl.
CPC ..... *A47C 7/425* (2013.01); *A47C 7/0213* (2018.08); *A47C 7/18* (2013.01); *A47C 7/405* (2013.01); *A47C 7/46* (2013.01)

(58) Field of Classification Search
CPC ..... A47C 7/46; A47C 7/0213; A47C 7/42; A47C 7/021; A47C 7/18; A47C 7/405; A47C 7/448; A47C 7/425
See application file for complete search history.

(56) References Cited

U.S. PATENT DOCUMENTS

| | | | | |
|---|---|---|---|---|
| 6,938,956 | B1 * | 9/2005 | Piretti | A47C 7/38 297/284.7 |
| 9,585,484 | B1 * | 3/2017 | Tsai | A47C 7/40 |
| 10,264,890 | B2 * | 4/2019 | Aldrich | A47C 7/462 |
| 2005/0184570 | A1 * | 8/2005 | Sanchez | A47C 7/446 297/300.3 |
| 2007/0236066 | A1 * | 10/2007 | Sanchez | A47C 7/46 297/353 |

* cited by examiner

*Primary Examiner* — Syed A Islam
(74) *Attorney, Agent, or Firm* — Hanrahan Law Firm, P.A.; Benjamin M. Hanrahan

(57) ABSTRACT

A lumbar support assembly for an office chair is presented herein. The lumbar support assembly includes at least one extension pad assembly which may be mounted to an existing lumbar support structure of an office chair. The extension pad assembly includes a base and a pad, wherein the base includes a recessed mounting structure disposed one side thereof. The recessed mounting structure is defined by a recessed surface at least partially surrounded by a retention wall, with the pad mounted to the opposite side of the base. One or more mounting clips extend from the retaining wall allowing the existing lumbar support structure to be snapped and engaged therein. With the extension pad assembly mounted in this manner, additional pressure and support can be added to the lumbar region of an individual seated in the chair.

18 Claims, 7 Drawing Sheets

EXTENSION LUMBAR SUPPORT PADS FOR OFFICE CHAIR

FIELD OF THE INVENTION

The present invention is generally directed to a lumbar support assembly, and more specifically to a padded assembly or add-on structure that can be attached to an existing lumbar support structure of an office chair, or other like chair or furniture, in order to extend the padded surface and therefore provide additional or enhanced lumbar support.

BACKGROUND OF THE INVENTION

For many office workers, students, or individuals who may spend any amount of time seated in an office chair throughout the work day, back pain can be a common problem, particularly in the event the office chair lacks effective lumbar support. The term "lumbar" generally refers to the lower region of an individual's back, and therefore, a lumbar support is generally a part of furniture that focuses on maintaining comfort in the lumbar region of the individual's back. An effective lumbar support can prevent or minimize back pain by properly aligning the individual's back muscles and spine while seated in the chair. Overall and over time, an effective lumbar support can reduce the tension in one's back and drastically improve one's posture.

For this reason, many chairs, and in particular, office chairs, include some sort of lumbar support, or at least a structure that is advertised as a lumbar support. As just an example, HERMAN MILLER, INC. is a company or entity that produces, manufactures, sells or otherwise distributes an office chair under the AERON® trademark. The AERON® office chair, and perhaps others, whether made by or for HERMAN MILLER® or another company or entity, includes two (2) lumbar support structures vertically aligned with one another and which push against the rear-facing surface of the back panel of the chair.

The problem, however, is that many lumbar supports or structures intended to provide lumbar support are not effective or otherwise do not provide the intended or desired lumbar support. Further, since every individual is different, a lumbar support structure that may be effective for one may not be effective for another.

Accordingly, there is a need in the art for an extension pad or an assembly which can be mounted to the existing lumbar support structures of an office chair in order to provide additional or enhanced lumbar support.

SUMMARY OF THE INVENTION

Specifically, at least one embodiment of the present invention is directed to a lumbar support assembly for an office chair, or otherwise, an extension pad assembly which may be mounted to one or more existing lumbar support structures of an office chair.

More in particular, the lumbar support assembly of at least one embodiment includes at least one extension lumbar support pad assembly, sometimes referred to herein as an extension pad assembly, mountable to the at least one lumbar support structure of the office chair. The extension pad assembly includes a base and a pad, wherein the base includes a recessed mounting structure disposed one side thereof. The recessed mounting structure is defined by a recessed surface at least partially surrounded by a retention wall, with the pad mounted to the opposite side of the base.

Furthermore, the recessed mounting structure of at least one embodiment includes one or more mounting clips that extend from the retaining wall allowing the existing lumbar support structure to be snapped and engaged therein. With the extension pad assembly mounted in this manner, additional pressure and support can be added to the lumbar region of an individual seated in the chair.

These and other objects, features and advantages of the present invention will become more apparent when the drawings as well as the detailed description are taken into consideration.

BRIEF DESCRIPTION OF THE DRAWINGS

Like reference numerals refer to like parts throughout the several views of the drawings provided herein.

DETAILED DESCRIPTION OF THE INVENTION

Figure 1:
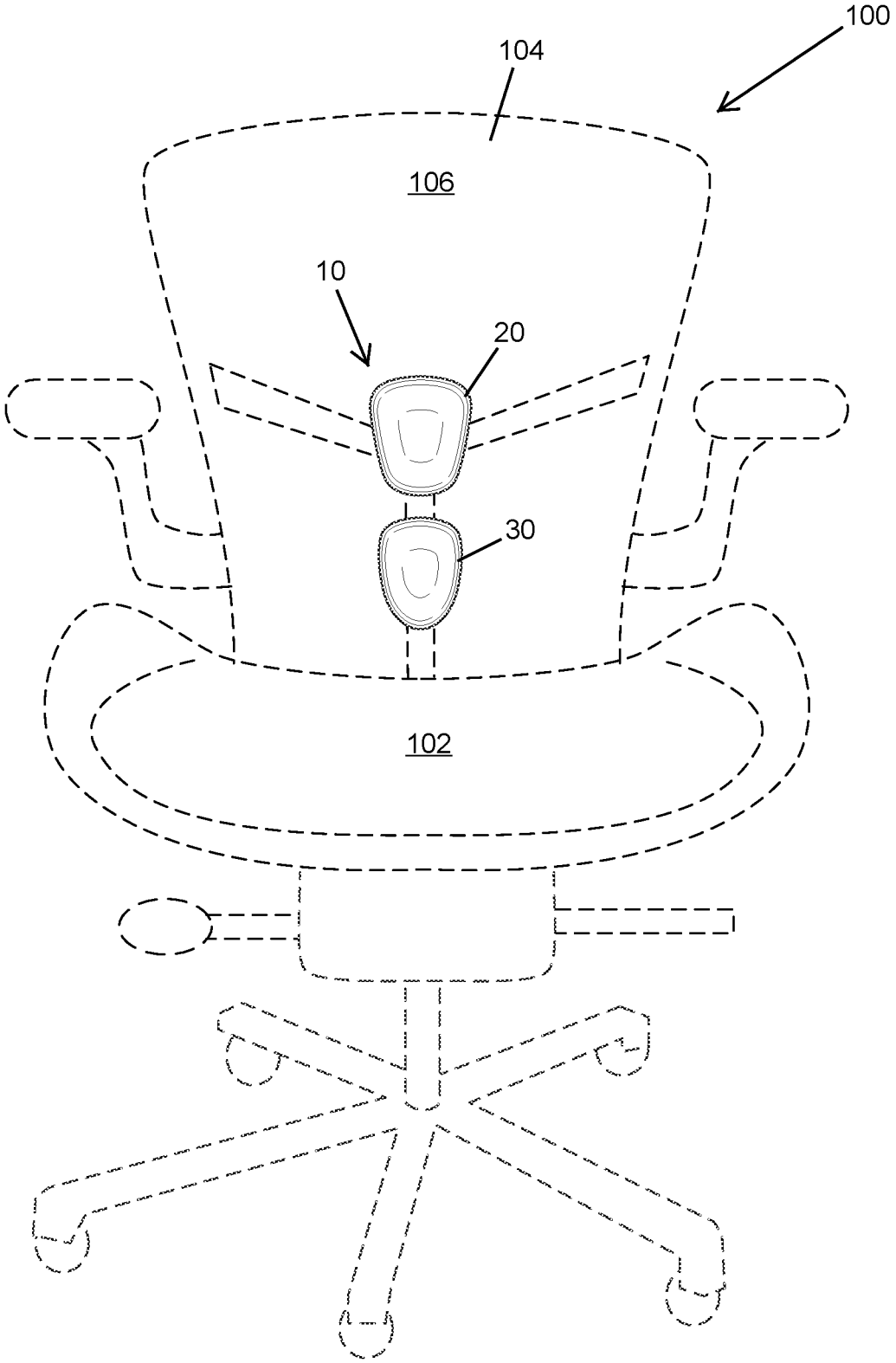
FIG. 1 is a front plan view of the lumbar support assembly with two extension lumbar support pad assemblies mounted to a chair as disclosed in accordance with at least one embodiment of the present invention.
Figure 2:
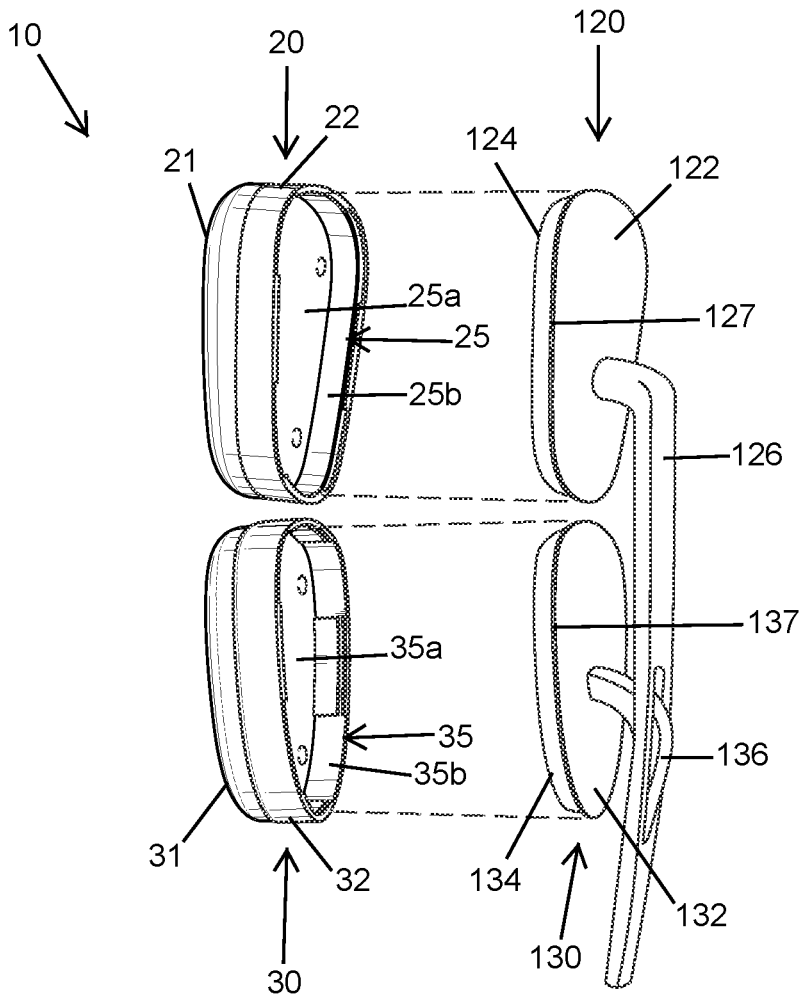
FIG. 2 is a perspective, exploded view of the lumbar support assembly with two extension lumbar support pad assemblies being mounted to existing lumbar support structures as disclosed in accordance with at least one embodiment of the present invention.
Figure 3:
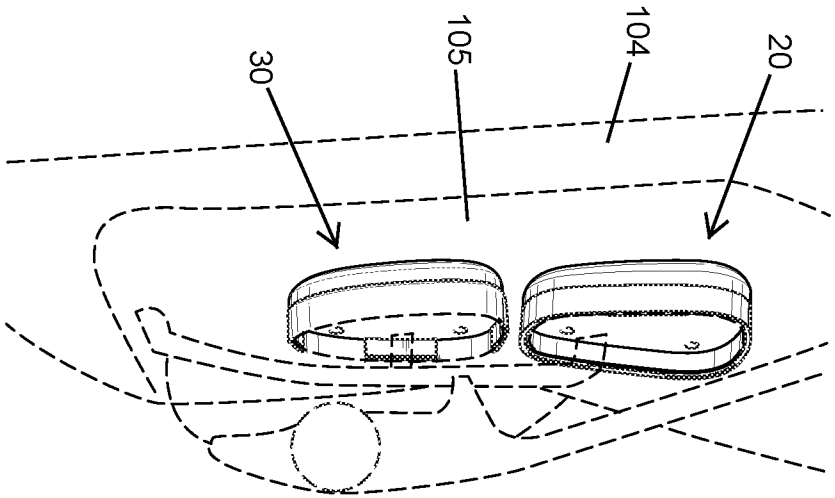
FIG. 3 is a perspective view of the lumbar support assembly with two extension lumbar support pad assemblies mounted to a chair as disclosed in accordance with at least one embodiment of the present invention.
Figure 5A:
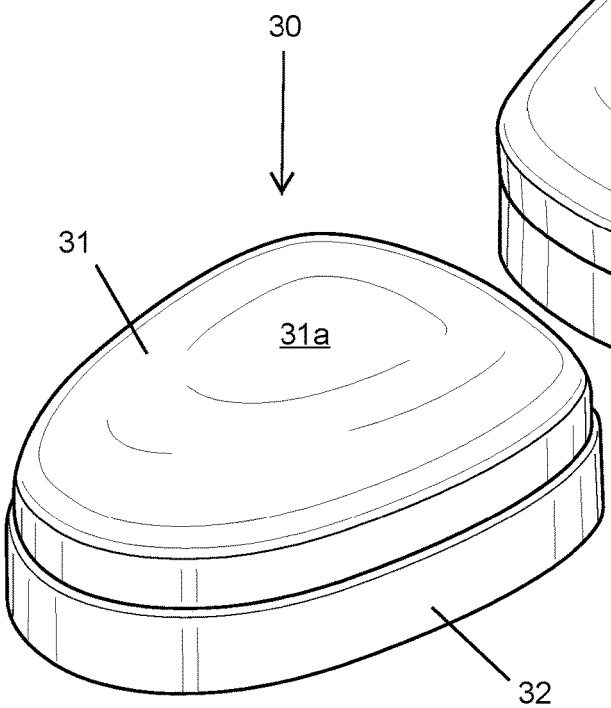
FIG. 5A is a front perspective view of a second or lower extension lumbar support pad assembly as disclosed in accordance with at least one embodiment of the present invention.

As shown in the accompanying drawings, and with particular reference to FIGS. 1-3, the present invention is generally directed to a lumbar support assembly, referenced as 10, for an office chair, referenced as 100. More specifically, the present invention includes at least one, although in many implementations two, extension lumbar support assemblies 20, 30 (sometimes referred to herein as extension pad assemblies) which are structured and configured to mount to existing lumbar support structures 120, 130 of an office, or other type of chair, generally referenced as 100. For example, some office (or other) chairs 100 include existing support pads or other like structures that are designed or intended to provide support to the lumbar region of a user or an individual sitting in the seat 102 of the chair. The term "lumbar" generally refers to the lower region of an individual's back, and therefore, a lumbar support is generally a part of furniture that focuses on maintaining comfort in the lumbar region of the individual's back. In some cases, this may include a lumbar support structure on or near the back portion 104 of the chair 100 or other furniture.

As just an example, HERMAN MILLER, INC. is a company or entity that produces, manufactures, sells or otherwise distributes an office chair under the AERON® trademark. The AERON® office chair, and perhaps others, whether made by or for HERMAN MILLER® or another company or entity, includes two (2) lumbar support structures, such as a first or upper lumbar support structure 120 and a second or lower lumbar support structure 130. The support structures 120. 130 each include a plate 122, 132 with a pad, cushion or cushioned surface, generally referenced as 124, 134 extending therefrom. In some cases, such as in the example shown in FIGS. 1-3, the lumbar support structures 120, 130 may have different shapes, sizes or configurations in that the first lumbar support structure 120 may have a different shape or size than the second lumbar support structure. In the example, provided, and in the case of the HERMAN MILLER® AERON® chair, the upper or first lumbar support structure 120 has a larger circumferential surface than the second lumbar support structure 130, although other embodiments and configurations are contemplated.

Moreover, in use, the pad or cushioned surface of the lumbar support structures 120, 130 of the chair 100 pushes or rests against the rear surface 104 of the back portion 104 of the chair 100. In some cases, such as with the AERON® chair, the back portion 104 of the chair 100 is resilient or made of a resilient or flexible material such that pressing against the rear surface 105 of the back portion 104 can be felt by an individual resting his or her back against the front-facing surface 106 of the back portion 104.

In some chairs 100, such as but not limited to the HERMAN MILLER® AERON® office chair, lumbar support structure(s) 122, 132 are mounted to one or more supports, e.g., as referenced at 126, 136. The supports 126, 136 may be flexible or at least partially pivotal such that the support structures 120, 130 (e.g., the plate(s) 122, 132 and pads 124, 134) can flex toward and away from the back portion 104 of the chair 100.

As described herein, the various embodiments of the present invention are intended to be mounted or connected to the existing lumbar support structure(s) 120, 130 of a chair 100 in order to extend the support surface thereof toward the user's lower back or otherwise toward the back portion 104 of the chair 100 in a location at or near the lumbar region of the user's back when properly seated in the chair 100. Extending the support surface the lumbar supports toward the chair 100 or otherwise toward the front of the chair, results in increased pressure against the user's lumbar region and therefore provides additional or superior support thereto. It should be noted that while the HERMAN MILLER® AERON® office chair is used as an example in this disclosure and is generally represented in the Figures, e.g., in FIGS. 1-3, the present invention is not limited to use with that particular chair and may thus be operable and mountable to other chairs in a similar manner.

More specifically, the lumbar support assembly 10 of at least one embodiment includes at least one, but in several embodiments, two extension pad assemblies 20, 30 that are each configured to fit over or otherwise mount over the padded surface 124, 134 of a corresponding one of the existing lumbar support structures 120, 130. By mounting the extension pad assemblies 20, 30 to the existing support structures 120, 130 in this manner, the supporting surface pressing against or toward the lumbar region of the user's back is extended.

For example, with reference to FIGS. 2 and 3, the lumbar support assembly 10 of at least one embodiment includes a first or upper extension lumbar support pad assembly 20 and a second or lower extension lumbar support pad assembly 30. The first extension pad assembly 20 is structured and configured to be mounted or attached to the first or upper lumbar support structure 20, whereas the second extension pad assembly 30 is structured and configured to be mounted or attached to the second or lower lumbar support structure 130. More specifically, each of the two extension pad assemblies 20, 30 of at least one embodiment are similarly structured although with different shapes, sizes and/or configurations in order to correspondingly fit over or mount to the respective one of the existing support structures 120, 130.

Specifically, the pad assemblies 20, 30 each include a base 22, 32 and a pad 21, 31. As shown in FIGS. 1-3, the base 22, 32 mounts in an overlying relation to the existing lumbar support structures 120, 130 with the pads 21, 31 extending in a opposite direction and in a position to provide support to the lumbar region of a user's back. In other words, the pads 21, 31 extend or add to the depth of the existing lumbar supports 120, 130, such that the outer surface of the pads 21*a*, 31*a* extends farther from the plates 122, 132 than the original or existing pads 124, 134.

FIGS. 4A-4I illustrate various views and angles of the first or upper extension pad assembly 20, whereas FIGS. 5A-5I illustrate various views and angles of the second or lower extension pad assembly 30.

For example, the base 22, 32 of the extension pad assemblies 20. 30 each define a corresponding recessed mounting structure 25, 35 or otherwise a recessed cavity within which a corresponding one of the existing lumbar support structures 120, 130 is disposed.

More specifically, the first base 22 defines a recessed cavity 25 which is specifically structured and configured to receive the pad 124 and plate 122 of the first or upper lumbar support structure 120 of the chair 100. In the example shown, the existing lumbar support structure 120 has a rounded trapezoidal shape, e.g., a trapezoidal shape with pronounced rounded corners. As a result, the first base 22 also includes a recessed cavity or mounting structure 25 with a similar shape such that the existing lumbar support structure 120 fits therein. In other embodiments, the shape and/or size of the recessed mounting structure may be different in order to correspond to or otherwise receive a differently shaped lumbar support structure of a chair 100.

In any event, the recessed mounting structure 25 is defined by or otherwise includes a recessed surface 25*a* at least partially surrounded by a retention wall 25*b*. In some embodiments, an in particular, the embodiment illustrated, the retention wall 25*b* completely surrounds the recessed surface 25*a*. In some embodiments, the recessed surface 25*a* is a flat planar surface, however, it may be curved, bulbous, or otherwise have some concave or convex curvatures there along.

Furthermore, in at least one embodiment, the base 22 includes one or more mounting clips 26*a-d* disposed on the at least one retaining wall 25*b*. For instance, the mounting clip(s) 26*a-d* extend from the wall 25*b* and define an ledge or overhang which is configured to engage to or clip onto the existing lumbar support structure 120, and in particular, the plate 122 thereof. In some cases, as shown the exemplary embodiment, the one or more mounting clips 26*a-d* extend from an outermost edge of the retaining wall 25*b*, although other locations structured and configured to implement the invention in the intended manner and mount to the existing lumbar support structure is contemplated within the full spirit and scope of the present invention.

Moreover, the embodiment illustrated includes four (4) mounting clips 26*a*, 26*b*, 26*c*, 26*d* disposed in a spaced relation from one another (e.g., there is a space between each of the mounting clips). For instance, each side of the rounded trapezoidal shape of the extension pad assembly 20 includes at least one mounting clip 26*a-d*, although other locations of the mounting clips 26*a-d*, and more or less mounting clips 26*a-d* are contemplated herein.

Figure 4A:
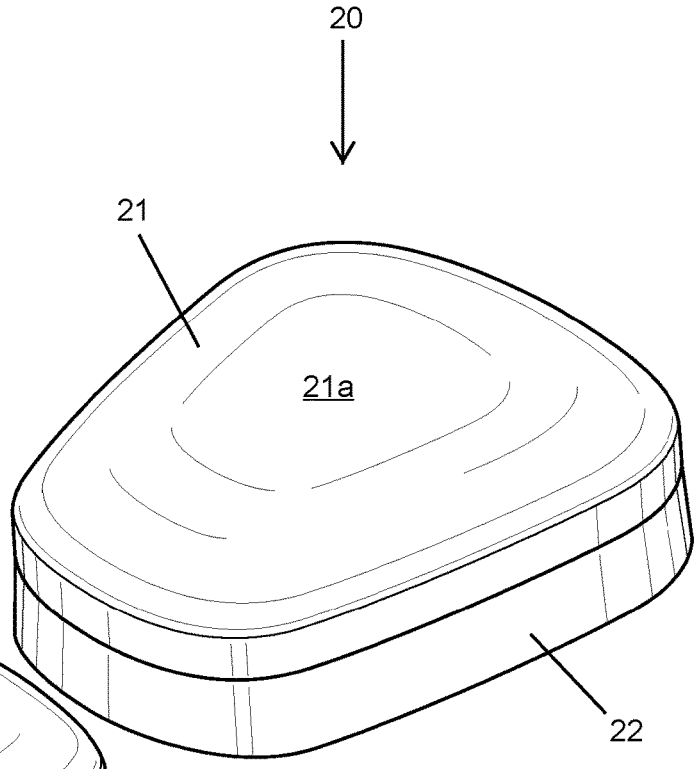
FIG. 4A is a front perspective view of a first or upper extension lumbar support pad assembly as disclosed in accordance with at least one embodiment of the present invention.
Figure 4B:
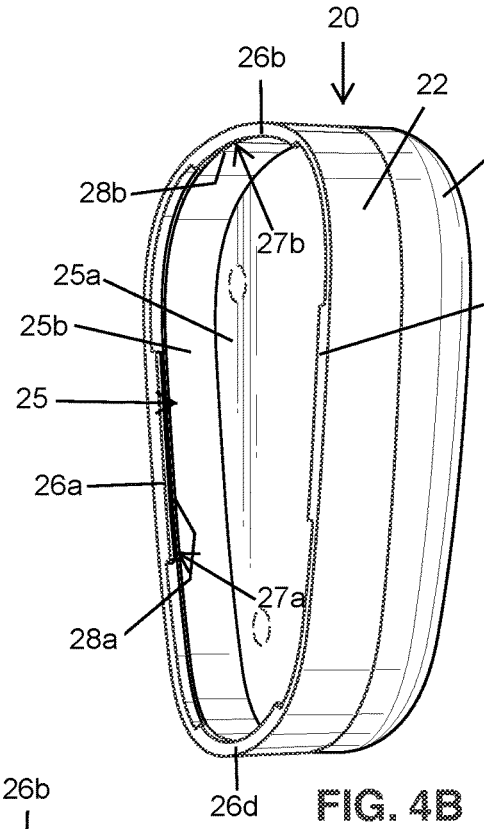
FIG. 4B is a rear-left perspective view of the first or upper extension lumbar support pad assembly as disclosed in accordance with at least one embodiment of the present invention.
Figure 4C:
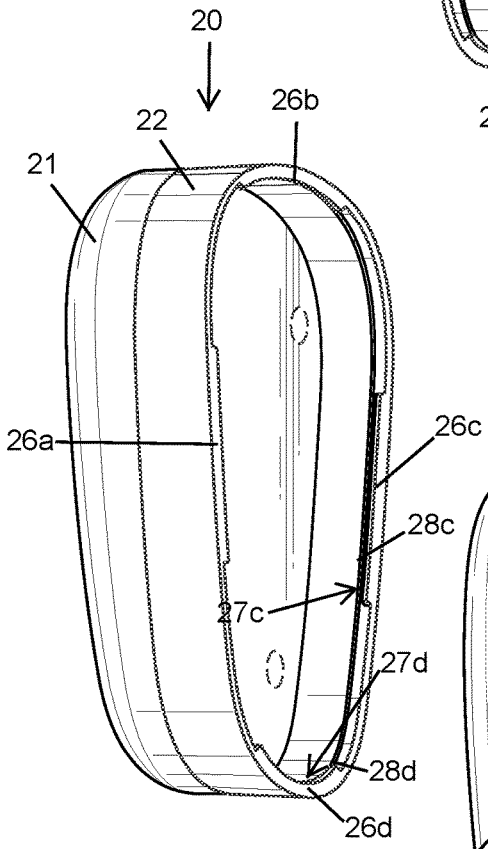
FIG. 4C is a rear-right perspective view of the first or upper extension lumbar support pad assembly as disclosed in accordance with at least one embodiment of the present invention.

More specifically, with reference to FIGS. 4B and 4C, in at least one embodiment, the mounting clips 26*a-d* define a channel 27*a-d* within which an edge 127 of the plate 122 of the existing lumbar support structure 120 is engaged or disposed. In particular, the channel 27*a-d* is defined as a space between the corresponding mounting clip 26*a-d* and a lower or inner ledge 28*a-d*. The channel 27*a-d* includes a width (measured between the bottom surface of the corresponding clip 26*a-d* and a top surface of the corresponding ledge 28*a-d*) that is equal to, substantially equal to or slightly larger than the width of the edge 127 of the plate 122.

Furthermore, the remaining depth of the recessed mounting structure 25 (e.g., measured between the ledge 28*a* and the recessed surface 25*a*) is equal to, substantially equal to, or at least slightly larger than the depth of the pad 124 disposed on the corresponding lumbar support structure 120.

In this manner, the existing lumbar support structure 120 can snap fit into the recessed mounting structure 25 of extension pad assembly 20 such that the mounting clip(s) 26*a-d* engage the outer edge(s) of the plate 122 of the existing lumbar support structure 120 of the office chair. In some cases, since the existing lumbar support structure 120 is somewhat flexible or bendable, for example, via the flexible rod 126, installation of the extension pad assembly 20 is as easy as flexing or bending the existing lumbar support structure 120 away from the back panel 104 of the chair, positioning the extension pad assembly 20 between the back panel 104 of the chair 100 and the existing lumbar support structure 120, and snapping the existing lumbar support structure 120 into the recessed mounting structure 25.

With the extension pad 21 disposed on the opposite side of the base 22 (e.g., opposite the recessed mounting structure 25), the extension pad 21 acts an extended lumbar support for the chair, engaging or contacting a user's lumbar region through the back panel 104 of the chair 100.

Further, and similar to the first or upper extension pad assembly 20, the second base 32 of the second or lower extension pad assembly 30 defines a recessed cavity 35 which is specifically structured and configured to receive the pad 134 and plate 132 of the second or lower lumbar support structure 130 of the chair 100. In the example shown in the Figures, the existing lumbar support structure 130 has a rounded oblong or egg shape, e.g., a substantially oval or rounded shape with one end wider than the other. As a result, the second base 32 also includes a recessed cavity or mounting structure 35 with a similar and corresponding shape, such that the existing lumbar support structure 130 fits therein. In other embodiments, the shape and/or size of the recessed mounting structure 35 may be different in order to correspond to or otherwise receive a differently shaped lumbar support structure of a chair 100.

In any event, the recessed mounting structure 35 is defined by or otherwise includes a recessed surface 35*a* at least partially surrounded by a retention wall 35*b*. In some embodiments, and in particular, the embodiment illustrated, the retention wall 35*b* completely surrounds the recessed surface 35*a*. In some embodiments, the recessed surface 35*a* is a flat planar surface, however, it may be curved, bulbous, or otherwise have some concave or convex curvatures there along.

Furthermore, in at least one embodiment, the base 32 includes one or more mounting clips 36*a-d* disposed on the at least one retaining wall 35*b*. For instance, the mounting clip(s) 36*a-d* extend from the wall 35*b* and define an ledge or overhang which is configured to engage to or clip onto the existing lumbar support structure 130, and in particular, the plate 132 thereof. In some cases, as shown the exemplary embodiment, the one or more mounting clips 36*a-d* extend from an outermost edge of the retaining wall 35*b*, although other locations structured and configured to implement the invention in the intended manner and mount to the existing lumbar support structure is contemplated within the full spirit and scope of the present invention.

Moreover, the embodiment illustrated includes four (4) mounting clips 36*a*, 36*b*, 36*c*, 36*d* disposed in a spaced relation from one another (e.g., there is a space between each of the mounting clips.)

Figure 5B:
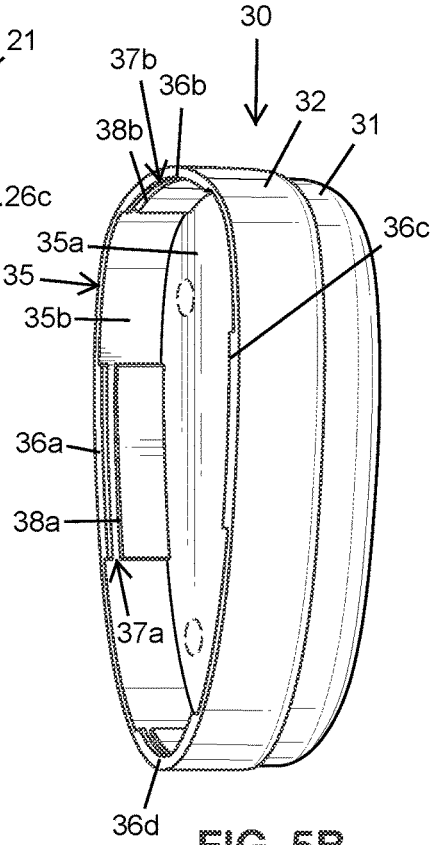
FIG. 5B is a rear-left perspective view of the second or lower extension lumbar support pad assembly as disclosed in accordance with at least one embodiment of the present invention.
Figure 5C:
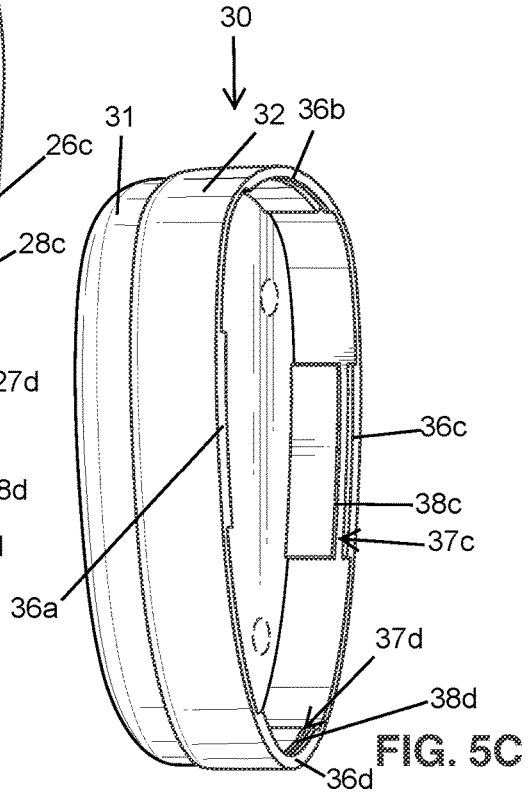
FIG. 5C is a rear-right perspective view of the second or lower extension lumbar support pad assembly as disclosed in accordance with at least one embodiment of the present invention.
Figure 4E:
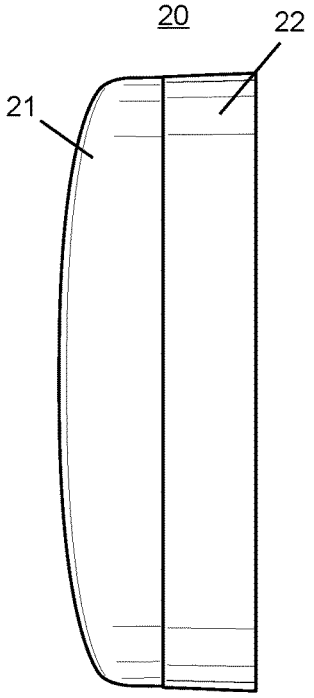
FIG. 4E is a left-side view of the first or upper extension lumbar support pad assembly as disclosed in accordance with at least one embodiment of the present invention.
Figure 4D:
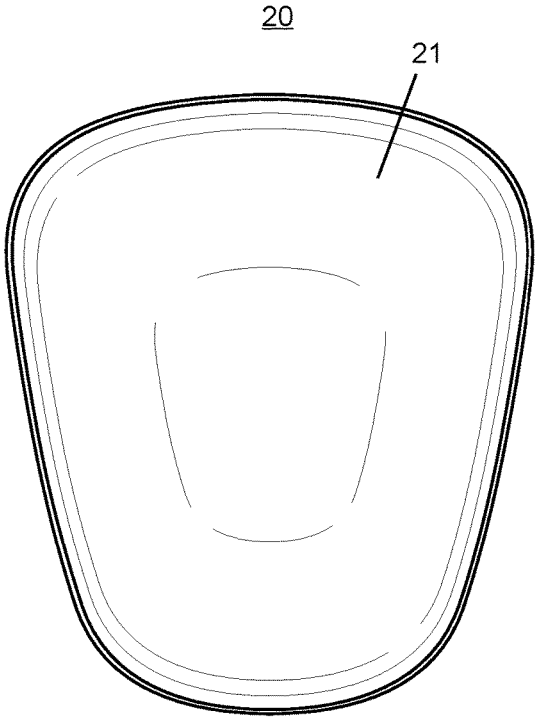
FIG. 4D is a front plan view of the first or upper extension lumbar support pad assembly as disclosed in accordance with at least one embodiment of the present invention.
Figure 4F:
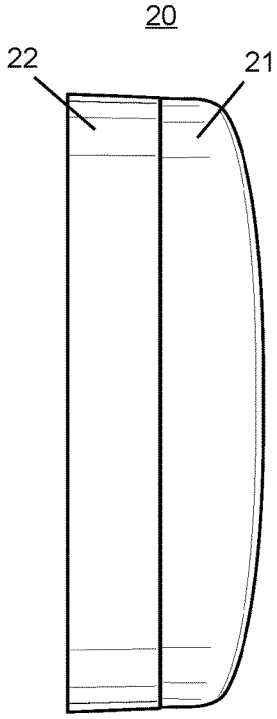
FIG. 4F is a right-side view of the first or upper extension lumbar support pad assembly as disclosed in accordance with at least one embodiment of the present invention.
Figure 5E:
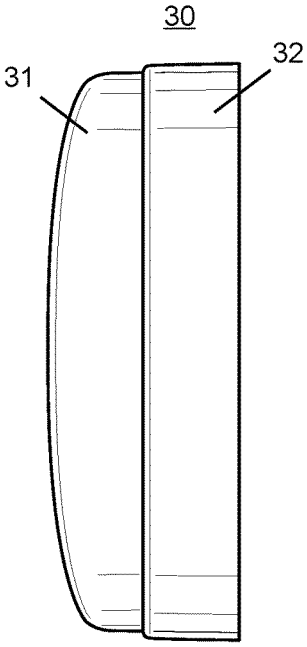
FIG. 5E is a left-side view of the second or lower extension lumbar support pad assembly as disclosed in accordance with at least one embodiment of the present invention.
Figure 5D:
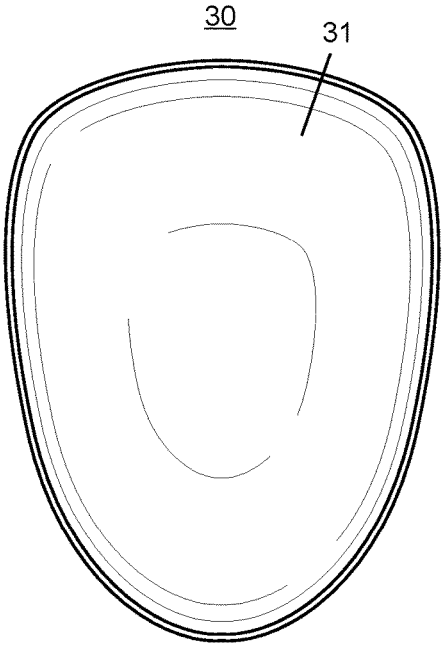
FIG. 5D is a front plan view of the second or lower extension lumbar support pad assembly as disclosed in accordance with at least one embodiment of the present invention.
Figure 5F:
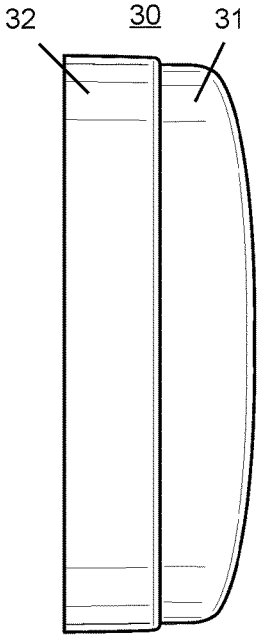
FIG. 5F is a right-side view of the second or lower extension lumbar support pad assembly as disclosed in accordance with at least one embodiment of the present invention.
Figure 4H:
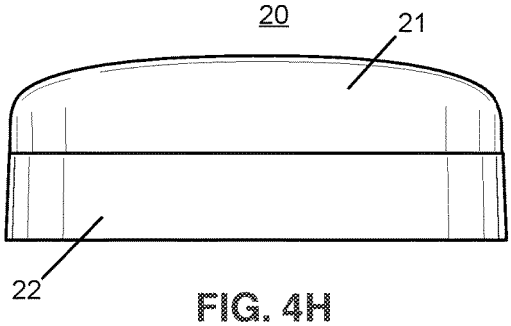
FIG. 4H is a top view of the first or upper extension lumbar support pad assembly as disclosed in accordance with at least one embodiment of the present invention.
Figure 5H:
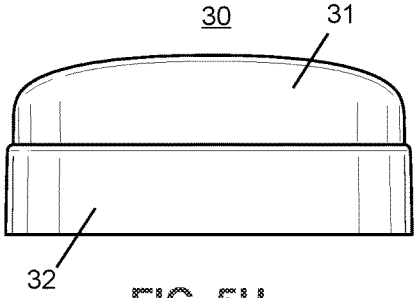
FIG. 5H is a top view of the second or lower extension lumbar support pad assembly as disclosed in accordance with at least one embodiment of the present invention.
Figure 4G:
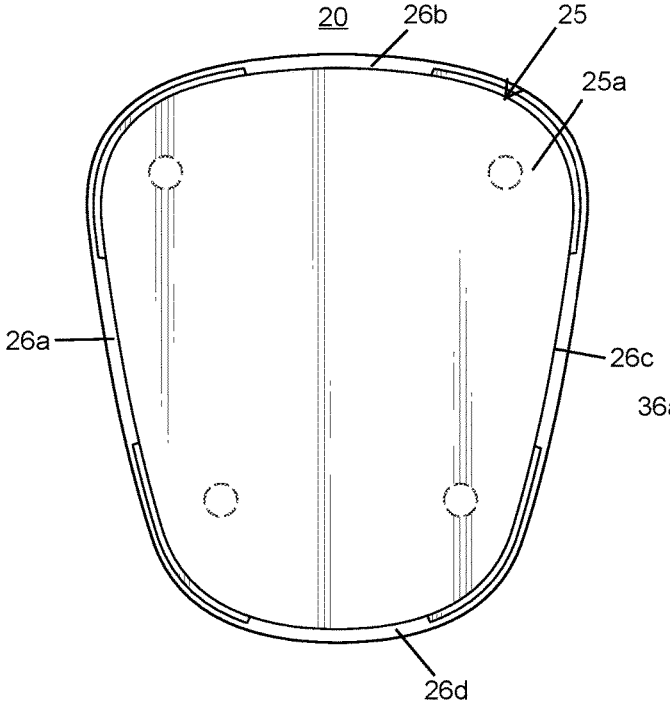
FIG. 4G is a rear view of the first or upper extension lumbar support pad assembly as disclosed in accordance with at least one embodiment of the present invention . . .
Figure 5G:
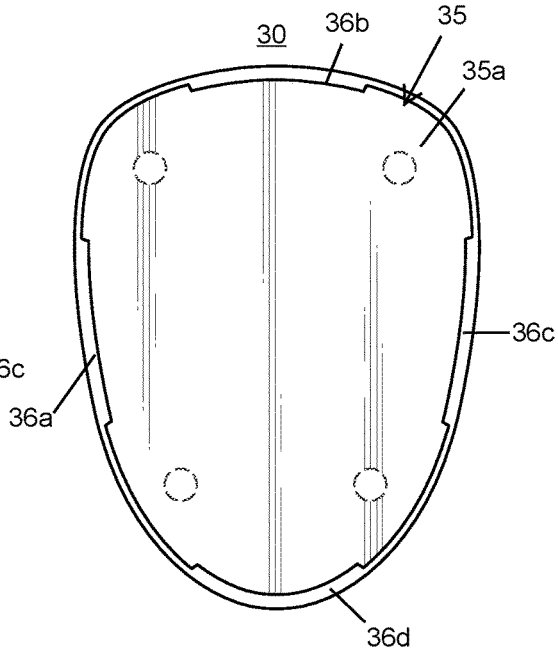
FIG. 5G is a rear view of the second or lower extension lumbar support pad assembly as disclosed in accordance with at least one embodiment of the present invention . . .
Figure 4I:
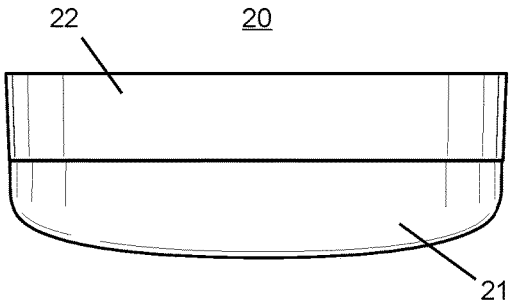
FIG. 4I is a bottom view of the first or upper extension lumbar support pad assembly as disclosed in accordance with at least one embodiment of the present invention.
Figure 5I:
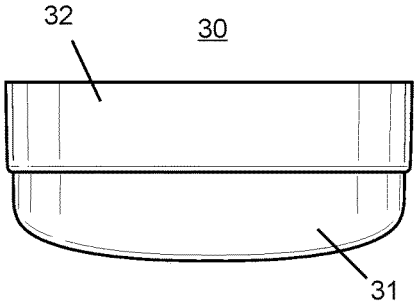
FIG. 5I is a bottom view of the second or lower extension lumbar support pad assembly as disclosed in accordance with at least one embodiment of the present invention.

More specifically, with reference to FIGS. 5B and 5C, in at least one embodiment, the mounting clips 36*a-d* define a channel 37*a-d* within which an edge 137 of the plate 132 of the existing lumbar support structure 130 is engaged or disposed. In particular, the channel 37*a-d* is defined as a space between the corresponding mounting clip 36*a-d* and a lower or inner ledge 38*a-d*. The channel 37*a-d* includes a width (measured between the bottom surface of the corresponding clip 36*a-d* and a top surface of the corresponding ledge 38*a-d*) that is equal to, substantially equal to or slightly larger than the width of the edge 137 of the plate 132.

Furthermore, the remaining depth of the recessed mounting structure 35 (e.g., measured between the ledge 38*a* and the recessed surface 35*a*) is equal to, substantially equal to, or at least slightly larger than the depth of the pad 134 disposed on the corresponding lumbar support structure 130.

In this manner, the existing lumbar support structure 130 can snap fit into the recessed mounting structure 35 of extension pad assembly 30 such that the mounting clip(s) 36*a-d* engage the outer edge(s) of the plate 132 of the existing lumbar support structure 130 of the office chair. In some cases, since the existing lumbar support structure 130 is somewhat flexible or bendable, for example, via the flexible rod 136, installation of the extension pad assembly 30 is as easy as flexing or bending the existing lumbar support structure 130 away from the back panel 104 of the chair, positioning the extension pad assembly 30 between the back panel 104 of the chair 100 and the existing lumbar support structure 130, and snapping the existing lumbar support structure 130 into the recessed mounting structure 35.

With the extension pad 31 disposed on the opposite side of the base 32 (e.g., opposite the recessed mounting structure 35), the extension pad 31 acts an extended lumbar support for the chair, engaging or contacting a user's lumbar region through the back panel 104 of the chair 100.

Furthermore, it should be noted that the bases 22, 32 of the extension pad assemblies 20, 30 of at least one embodiment of the present invention may be constructed of a variety of different materials including rigid or semi-rigid materials, which may include, but are in no way limited to plastic materials, thermoplastic polyurethane materials (TPU), silicone, a mixture or combination thereof, metal, aluminum, etc. Other materials may be used and are contemplated within the full spirit and scope of the present invention.

In addition, the pads 21, 31 of the extension pad assemblies 20, 30 of at least one embodiment of the present invention may also be constructed of a variety of different materials, including generally pliable, flexible, soft, cushioned, padded materials, such as, for example, foam, gel, a mixture or combination of foam and gel, etc. Of course, other materials structured to facilitate implementation of the present invention are contemplated within the full spirit and scope herein.

Furthermore, in some embodiments, one or both of the pads 21, 31 are fixedly attached to the corresponding base 22, 32, for example, through adhesion, heat, screws, bolts, nails, or other like fasteners configured to fixedly attach the elements to another such that their removal is not intended. In other embodiments, however, the pad(s) 21, 31 may be removably attached or removably connected to the corresponding base 22, 32 through any available connection fasteners or techniques, including, but not limited one or more cooperative magnets, hook and loop type fasteners (e.g., VELCRO®), snaps, button, clips, clamps, tongue and groove connections, etc. In such a case, a user may be able to remove and/or replace the pad(s) 21, 31 with other pad(s) 21, 31 that may have different cushioned or padded qualities, different thicknesses, different rigidity or softness, different sizes, different shapes, different colors/patterns, etc.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention. This written description provides an illustrative explanation and/or account of the present invention. It may be possible to deliver equivalent benefits using variations of the specific embodiments, without departing from the inventive concept. This description and these drawings, therefore, are to be regarded as illustrative and not restrictive.

Now that the invention has been described,

What is claimed is:

1. A lumbar support assembly for an office chair, the office chair comprising a first lumbar support structure and a second lumbar support structure, the first lumbar support structure comprising a plate and a cushioned surface extending therefrom, the second lumbar support structure comprising a plate and a cushioned surface extending therefrom, said lumbar support assembly comprising:

a first extension lumbar support pad assembly mountable to the first lumbar support structure of the office chair, and a second extension lumbar support pad assembly mountable to the second lumbar support structure of the office chair, said first extension lumbar support pad assembly comprising:

a base and a pad, said base of said first extension lumbar support pad assembly comprising a recessed mounting structure defined by a recessed surface at least partially surrounded by a retention wall, said pad of said first extension lumbar support pad assembly being mounted to said base of said first extension lumbar support pad assembly opposite said recessed mounting structure, and said second extension lumbar support pad assembly comprising:

a base and a pad, said base of said second extension lumbar support pad assembly comprising a recessed mounting structure defined by a recessed surface at least partially surrounded by a retention wall, said pad of said second extension lumbar support pad assembly being mounted to said base of said first extension lumbar support pad assembly opposite said recessed mounting structure.

2. The assembly as recited in claim 1 wherein said recessed mounting structure of said base of said first extension lumbar support pad assembly comprises at least one mounting clip disposed on said retaining wall thereof.

3. The assembly as recited in claim 2 wherein said at least one mounting clip of said first extension lumbar support pad assembly extends from an outer edge of said retaining wall thereof.

4. The assembly as recited in claim 2 wherein said recessed mounting structure of said base of said first extension lumbar support pad assembly comprises a plurality of mounting clips each disposed in a spaced relation from one another.

5. The assembly as recited in claim 4 wherein said recessed mounting structure of said base of said second extension lumbar support pad assembly comprises at least one mounting clip disposed on said retaining wall thereof.

6. The assembly as recited in claim 5 wherein said at least one mounting clip of said second extension lumbar support pad assembly extends from an outer edge of said retaining wall thereof.

7. The assembly as recited in claim 5 wherein said recessed mounting structure of said base of said second extension lumbar support pad assembly comprises a plurality of mounting clips each disposed in a spaced relation from one another.

8. The assembly as recited in claim 7 wherein said recessed mounting structure of said first extension lumbar support pad assembly is sized to receive the first lumbar support structure of the office chair therein, and wherein said recessed mounting structure of said second extension lumbar support pad assembly is sized to receive the second lumbar support structure of the office chair therein.

9. The assembly as recited in claim 8 wherein said plurality of mounting clips of said first extension lumbar support pad assembly are configured to engage an edge of the plate of the first lumbar support structure of the office chair, and wherein said plurality of mounting clips of said second extension lumbar support pad assembly are configured to engage an edge of the plate of the second lumbar support structure of the office chair.

10. The assembly as recited in claim 9 wherein said plurality of mounting clips of said first extension lumbar support pad assembly define a channel within which the edge of the plate of the first lumbar support structure of the office chair is engaged.

11. The assembly as recited in claim 10 wherein said plurality of mounting clips of said second extension lumbar support pad assembly define a channel within which the edge of the plate of the second lumbar support structure of the office chair is engaged.

12. A lumbar support assembly for an office chair, the office chair comprising at least one lumbar support structure comprising a plate and a cushioned surface extending therefrom, said lumbar support assembly comprising:

at least one extension lumbar support pad assembly mountable to the at least one lumbar support structure of the office chair, said at least one extension lumbar support pad assembly comprising:

a base and a pad, said base comprising a recessed mounting structure defined by a recessed surface at least partially surrounded by a retention wall, said pad being mounted to said base opposite said recessed mounting structure.

13. The assembly as recited in claim 12 wherein said recessed mounting structure comprises at least one mounting clip disposed on said retaining wall.

14. The assembly as recited in claim 13 wherein said at least one mounting clip extends from an outer edge of said retaining wall thereof.

15. The assembly as recited in claim 13 wherein said recessed mounting structure comprises a plurality of mounting clips each disposed in a spaced relation from one another.

16. The assembly as recited in claim 15 wherein said recessed mounting structure is sized to receive the at least one lumbar support structure of the office chair therein.

17. The assembly as recited in claim 16 wherein said plurality of mounting clips are configured to engage an edge of the plate of the at least one lumbar support structure of the office chair.

18. The assembly as recited in claim 17 wherein said plurality of mounting clips each define a channel within which the edge of the plate of the at least one lumbar support structure of the office chair is engaged.

* * * * *